US009489899B2

(12) United States Patent
Ooga

(10) Patent No.: US 9,489,899 B2
(45) Date of Patent: Nov. 8, 2016

(54) CONTROL CIRCUIT FOR CONTINUOUS SMOOTH REDUCTION OF BACKLIGHT LUMINANCE, AND A DISPLAY THEREOF

(71) Applicant: NLT Technologies, Ltd., Kanagawa (JP)

(72) Inventor: Kouichi Ooga, Kanagawa (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 0 days.

(21) Appl. No.: 14/459,498

(22) Filed: Aug. 14, 2014

(65) Prior Publication Data

US 2015/0049129 A1 Feb. 19, 2015

(30) Foreign Application Priority Data

Aug. 15, 2013 (JP) ..... 2013-168804
Apr. 26, 2014 (JP) ..... 2014-092158
Aug. 5, 2014 (JP) ..... 2014-159930

(51) Int. Cl.
*G09G 3/34* (2006.01)

(52) U.S. Cl.
CPC ..... *G09G 3/3406* (2013.01); *G09G 2320/064* (2013.01); *G09G 2320/0646* (2013.01); *G09G 2360/16* (2013.01)

(58) Field of Classification Search
CPC ..... G09G 3/3406; G09G 2320/064; G09G 2360/16; G09G 2320/0646
See application file for complete search history.

(56) References Cited

U.S. PATENT DOCUMENTS

2008/0231581 A1 9/2008 Fujine et al.
2009/0304274 A1* 12/2009 Yoshii ..... G06T 5/009 382/167
2011/0050739 A1* 3/2011 Namioka ..... G09G 3/3406 345/690
2011/0109815 A1* 5/2011 Hosaka ..... G09G 3/3648 348/792
2012/0026208 A1* 2/2012 Kobiki ..... G09G 3/3406 345/690

FOREIGN PATENT DOCUMENTS

JP 2007-322901 A 12/2007
JP 2008-304580 A 12/2008
JP 2010-204654 A 9/2014
WO 2007046320 A1 4/2007

OTHER PUBLICATIONS

Communication dated Aug. 23, 2016, issued by the Japan Patent Office in corresponding Japanese Application No. 2014-159930.

* cited by examiner

*Primary Examiner* — Larry Sternbane
(74) *Attorney, Agent, or Firm* — Sughrue Mion, PLLC

(57) ABSTRACT

A control circuit having large effects of low power consumption in CABC drive is provided. The control circuit performs B/L luminance reduction in eliminating a discomfort in image quality by using the feature value calculation circuit in the video signal. The control circuit comprises a luminance control circuit controlling a backlight luminance according to an inputted video signal and a gradation conversion circuit for converting a gradation of inputted video signal according to a controlled luminance. The control circuit reduces continuously and smoothly the backlight luminance, while the screen area reaches one-pixel white, in case where the all white is inputted as video signal, one-pixel black is displayed in any screen area from a display condition of all white, a rate of screen area displaying one-pixel black is gradually increased, and the video signal is continuously changed until the screen area of all white reaches the one-pixel white.

8 Claims, 15 Drawing Sheets

(Black Background : 70%) (WhiteWindow : 30%)

(Feature Value : 255th Gradation)

(Black Background : 71%) (White Window : 29%)

(Feature Value : 0 Gradation)

CONTROL CIRCUIT FOR CONTINUOUS SMOOTH REDUCTION OF BACKLIGHT LUMINANCE, AND A DISPLAY THEREOF

INCORPORATION BY REFERENCE

This application is based upon and claims the benefit of priority from Japanese Patent Application No. 2013-168804, filed on Aug. 15, 2013, the disclosure of which is incorporated herein in its entirely by reference.

FIELD OF THE INVENTION

The present invention relates to a control circuit and a display device thereof. In particular, it relates to the control circuit and the display device thereof applied to various display devices such as data processor.

BACKGROUND OF THE INVENTION

In recent years, concerning the power consumption of thin display devices, low power consumption devices such as LED for a backlight (hereinafter, referred to as a B/L) used in liquid-crystal display devices have been developed. However, a value of B/L power consumption as related to total power consumption is still large when a display device or the like is used in the always on lighting condition.

In these display devices, a technique of B/L luminance controlled according to the input video signal has been known.

For example, when a wholly dark image has been inputted, it has been designed to reduce the B/L luminance and perform a gamma correction according to a reduced amount of luminance. As a result, low power consumption has been achieved by reducing the influence on visibility of a screen image. This method is called as CABC (Content Adaptive Brightness Control) control.

This method will be described in detail. In accordance with this method, when the input video signal is configured by the wholly dark gradation (low gradation), low power consumption can be achieved by increasing a reduction of B/L luminance, a gradation conversion volume (a rate of converting from low gradation to high gradation) and a transmittance rate of panel. When the inputted video signal is configured by the wholly bright gradation (high gradation), the original visibility of screen image can be obtained by the reduction of B/L luminance and the gradation conversion volume.

With this method, it is required to calculate a feature value of the video signal from the data (image data) in one frame of the inputted video signal in order to determine the reduction of luminance. In other words, as the reduction of luminance is determined by the feature value of the video signal, an image quality is affected by the feature value of the video signal. Thus, a calculation method of the feature value is important.

From a viewpoint of low power consumption, when the circuit itself for calculating the feature value gets too large, the power consumption increases in circuit. Thus, it is important to reduce a circuit scale.

PRIOR ART LITERATURES

Patent Literatures

Patent Literature 1 Patent Laid-open Publication No. 2008-304580

Patent Literature 2 Patent Laid-open Publication No. 2007-322901

Patent Literature 3 Patent Laid-open Publication No. 2010-204654

SUMMARY OF INVENTION

In the CABC driving circuit, as above mentioned, it is required to calculate the feature value of video signal in one frame in order to determine an amount of the reduction of B/L luminance. As the feature value of video signal is a value for changing the B/L luminance, the value is designed to affect an image quality.

Various calculation methods of the above feature value can be considered. Upon giving one example of the calculation method of the feature value as a method for using a histogram, this method is designed to represent a gradation value of the video signal of each pixel in one frame as a histogram and reduce the B/L luminance according to the histogram data.

There is, however, a problem, in which the luminance changes discontinuously in case of using the histogram. Then, this will be described with reference to FIG. 5.

For example, it will be considered as the feature value of video signal that the corresponding value (coefficients etc. may be provided therein) of the gradation value equivalent to the number falling on 30 percentage of total numbers, counting from the maximal gradation value of histogram is set as a feature value.

In the present invention, the video signal and the maximal gradation will be described as 8 bit and 255th gradation, respectively.

Image A is supposed to represent 30 percentage of white window (255th gradation) in black screen (0 gradation), and Image B is supposed to represent 29 percentage of white window (255th gradation) in black screen (0 gradation).

Comparing Image A with Image B, it will be seen that there are little or no apparent difference.

However, when the feature value of video signal setting an amount of the reduction of B/L luminance is set based on a histogram of the video signal in one frame, the Image A is supposed to set the gradation falling on 30 percentage of total numbers, counting from the maximal gradation as 255th gradation, and the Image B is supposed to set the gradation falling on 30 percentage of total numbers, counting from the maximal gradation as 0 gradation.

That is, the Image A is an amount of luminance reduction based on 255th gradation and the Image B is an amount of luminance reduction based on 0 gradation. Although there is little or no difference between the Image A and the Image B, large differences therebetween will occur in an amount of the luminance reduction.

When such video signals are inputted, a sense of discomfort occurs in the image quality. Specifically, when the image A is changed to the image B, the luminance in white window seems to become dark abruptly.

The feature value of video signal may be designed to use an average value of gradation of video signal in one frame in order to eliminate the discomfort in image quality. Upon considering an average value simply as the feature value of video signal, there is a problem in which it seems to be dark abruptly by having the corresponding amount of luminance reduction even in case of the video signal containing many in the side of high gradation.

Another calculation method of the feature value of video signal is designed to calculate a maximal gradation value of video signal at each pixel in one frame and reduce the B/L luminance based on the maximal gradation value.

With this method, a discomfort in image quality, in which the luminance becomes dark abruptly like a histogram, is eliminated.

In this method, when only one pixel in high gradation (gradation around 255th gradation) is contained in the video signal in one frame, the gradation may become the feature value of video signal. As a result, there are problems, in which an amount of luminance reduction becomes extremely small in spite of the wholly dark screen and a reduction of power consumption of CABC results in small effect. As an extraordinary example, the luminance cannot be reduced in case where 255th gradation exists in only one pixel of all black screens (0 gradation).

Furthermore, although a circuit is configured to assemble a plurality of the calculation method of feature value with use of threshold, criterion (or judgment condition) and the like, there exist the above-mentioned discontinuous change (abrupt change in luminance), deterioration in image quality by excessive reduction of luminance when the video signal containing relatively many of high gradation is inputted, effects of power reduction caused by existence of a small amount of high gradation, even in case of existence of low gradation and the like. As a result, there are causes of discomfort in image quality and problems expecting little or no effects of low power consumption in each element. Thus, all of these causes and problems cannot be eliminated.

For example, a conventional example described in Patent Literature 1 discloses that a calculation method of feature value of video signal by the CABC control is configured to determine one of mean value, maximal value, minimal value, and gradation distribution (histogram) or a plurality of combinations thereof, and perform the luminance control therewith. However, in case of a calculation method executed only by the above combinations, a discomfort in image quality occurs.

A conventional example described in Patent Literature 2 discloses that a calculation method is configured to calculate an average value of the input video signal, and raise the luminance and deepen the gamma value in case where the average value is smaller than the predetermined threshold. Then, a white screen portion becomes bright, and a black screen portion gets dark even in case of the wholly dark video signal. Thus, it is configured to raise the luminance even in case where the average value of video signal is small. In this example, there is a problem in which the luminance difference caused by a discontinuity of gamma characteristic becomes remarkable in the vicinity of the threshold in order to change a gamma curve as the threshold of the average value.

A conventional example described in Patent Literature 3 discloses that the maximal value and the average value of the previous frame are compared by thresholds thereof to change the luminance. However, there is a problem in which the luminance around the threshold is abruptly changed.

On the other hand, when it is configured to calculate various feature values and switch over at the threshold, the circuit scale results in too large size. Thus, a problem occurs in that it is against an object of the low power consumption.

When it is designed to reduce the B/L power consumption by a reduction of B/L luminance, the problem will be a discomfort in image quality. That is, a control circuit for reducing the power consumption in a state of eliminating the discomfort in image quality is important. Furthermore, unless the control circuit reduces its circuit scale in itself, the effects of power reduction will be prevented.

An object of the present invention is to provide a control circuit having larger effects of the low power consumption in CABC drive. The control circuit is configured to reduce the power consumption of circuit itself by reducing the circuit scale of feature value calculation circuit of video signal and perform B/L luminance reduction in a state of eliminating the discomfort in image quality.

In order to solve the above problem, the control circuit of the present invention comprises a luminance control circuit section controlling a backlight luminance according to an inputted video signal and a gradation conversion circuit section for converting a gradation of the inputted video signal according to the controlled luminance. Further, the control circuit is configured to reduce continuously and smoothly the backlight luminance, while the screen area reaches one-pixel from all white, in case where all white is inputted as the inputted video signal, one-pixel black is displayed in any screen area from a screen condition of all white, a rate of the screen area displaying the one-pixel black is gradually increased, and the inputted video signal is continuously changed until the screen area of all white reaches the one-pixel white.

In comparison with an amount of the luminance reduction calculated by the feature value generated with a linear function of an average value and a maximal value of gradation of the video signal in one frame of the inputted video signal, a change of the backlight luminance is configured to control a reduction of the backlight luminance such that an amount of luminance reduction is always less than or equal to an amount of luminance reduction calculated by the linear function.

In the above configuration, the control circuit according to the present invention comprises a circuit calculating the maximal value and the average value, a feature value coefficient set point section setting a plurality of predetermined coefficients, and a feature value calculation circuit section calculating a feature value of the video signal with use of the maximal value, the average value, and the predetermined coefficient. Further, the feature value of video signal is generated by polynomial function configured by only four members, which are a member multiplying a coefficient by a square of the average value, a member multiplying a coefficient by the average value, a member multiplying a coefficient by the maximal value, and a member multiplying a coefficient by a product of the average value and the maximal value, with use of the calculated maximal value and the calculated average value.

Further, the feature value of the video signal Rank is determined by the following equation (1) with use of the calculated maximal value MAX, the calculated average value AVE, and any coefficients a, b and p, q, $$\text{Rank}=(a/p)\times(1-(b/q)\times\text{AVE})\times\text{AVE}+(1-(a/p)\times(1-(b/q)\times\text{AVE}))\times\text{MAX} \quad (1)$$

and the backlight luminance is determined by the following equation (2) with use of PWM value, $$PWM=(\text{Rank}/f(n))\hat{}2.2 \quad (2)$$

f(n): maximal display gradation value (255 in case of 8 bit)

In addition, in a relationship between the average value and the PWM value, a rate of change of the PWM value is small and a gradient thereof is gentle in a large area of the average value, while the rate of change of the PWM value becomes large and a gradient thereof becomes steep, as the average value becomes smaller, and the rate of change of the PWM value is always smooth and continuous.

Furthermore, the any coefficients a and b are respectively set in a range of 1 to 1024 and a range of 0 to 31 to calculate the feature value of video signal.

On the other hand, the feature value coefficient set point section sets at least three coefficient and is configured to, have a feature value coefficient calculation section changing at least one coefficient according to the calculated maximal value, and calculating the feature value of the video signal by the changed coefficient.

With the calculated maximal value MAX, any coefficient b set by assuming the maximal value, and any coefficient c, a coefficient b_m is calculated by the following equation (3), $$b_m=(255/c)\times(f(n)/\mathrm{MAX})\times b \quad (3)$$

f(n): maximal display gradation value (255 incase of 8 bit) the feature value of the video signal RANK is determined by the following equation (4) with the calculated maximal value MAX the average value AVE, the any coefficient a the calculated coefficient b_m, and the coefficients p and q, $$\mathrm{Rank}=(a/p)\times(1-(b_m/q)\times\mathrm{AVE})\times\mathrm{AVE}+(1-(a/p)\times(1-(b_m/q)\times\mathrm{AVE}))\times\mathrm{MAX} \quad (4)$$

and the backlight luminance is determined by the following equation (5) with a PWM value $$PWM=(\mathrm{Rank}/f(n))\hat{}2.2 \quad (5)$$

Any coefficient c in the above case is set in the range of 1 to 254 to calculate the feature value of the video signal.

In addition, the display device according to the present invention is characterized by equipping with the control circuit.

EFFECT OF THE INVENTION

As above mentioned, it is configured to perform the CABC control with the feature value calculated by a calculation equation of the feature value or the coefficient b_m of the video signal and a calculation equation of the feature value of the video signal. Thus, it is possible to obtain a low power consumption with a driving circuit having the smallest circuit scale without a discomfort in image quality, which is, for example, an abrupt change of luminance caused by slight change of the inputted video signal, or a wholly dark impression in case of the input video signal containing many of high gradation.

In particular, the feature value of the video signal may be generated with a circuit configuration having a small circuit scale, that is, a polynomial equation configured only by four members, which are a member multiplying a coefficient by a square of the AVE value, a member multiplying a coefficient by the AVE value, a member multiplying a coefficient by the MAX value, and a member multiplying a coefficient by a product of the AVE value and the MAX value. That is, the present invention is characterized in that the circuit configuration may be configured only by a simple equation without using a ROM, a RAM, a LUT, and the like. As for the problem described in the conventional example 1, as the present invention comprises all of these members, it is possible to change the luminance continuously relative to the AVE value and eliminate a discomfort in image quality.

As for the problem described in the conventional example 2 and 3, the present invention is configured to calculate the feature value by a function including a member of a square of the average value and the maximal value, and have a continuousness of the gamma characteristic. Therefore, the continuous change can be obtained to have no abrupt change in the luminance.

BRIEF DESCRIPTION OF THE DRAWINGS

FIGS. 6A and 6B are views illustrating Image A, and FIGS. 6C and 6D are views illustrating Image B.

DETAILED DESCRIPTION OF THE PREFERRED EMBODIMENT

A calculation method of feature value of video signal is characterized by making a function with use of an average value (hereinafter, referred to as AVE value) and a maximal value (hereinafter, referred to as MAX value) of gradation of video signal in one frame and calculating the feature value by this function.

Specifically, the function is configured by only four members, that is, a member multiplying a coefficient by a square of AVE value, a member multiplying a coefficient by AVE value, a member multiplying a coefficient by MAX value, and a member multiplying a coefficient by a product of AVE value and MAX value. Then, the feature value of video signal is calculated by a function of polynomial with use of only arithmetical operation (exponential function and logarithmic function, and the like are undesirable because of complicated calculation). Accordingly, it increases an amount of luminance reduction in a state of extremely low discomfort in image quality as above mentioned.

From the point of view of reducing the circuit scale, the present invention describes a method for calculating the feature value of video signal in a minimal circuit scale A control circuit and a display device thereof will be, hereinafter, described with reference to drawings.

(Embodiment 1)

Figure 9:
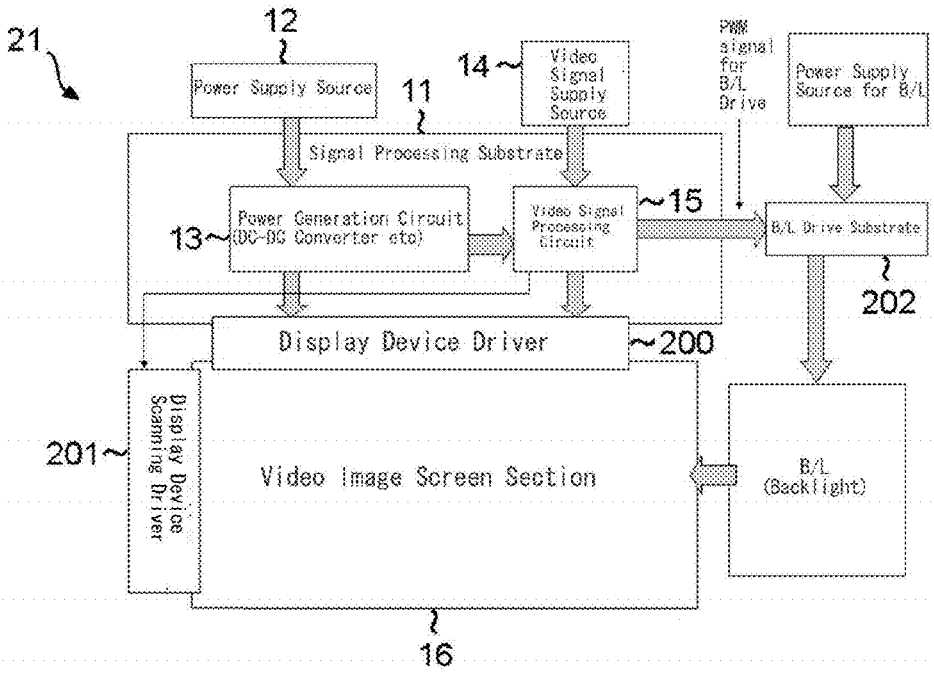
FIG. 9 is a whole block diagram in a display device of the present invention.

FIG. 9 shows a block diagram of whole display device. A signal processing substrate 11 is configured to supply power from a power supply source 12 to generate power for driving various ICs with use of power generation circuit such as DC-DC converter and drive the various ICs. A video signal supply source 14 is configured to supply video signal to perform signal processing for viewing images (including array conversion of signal, generation of vertical synchronizing signal, etc.) in a video image screen section 16 by a video signal processing circuit 15 and supply the video signal, as above processed, to a display device driver 200 and a display device scanning driver 201. As a result, the video image is shown in video image screen section 16.

As a liquid crystal display is required for a light source for viewing images, the power source supplied to B/L drive substrate 202 is configured to drive a circuit for putting on various signals or backlight to put on the backlight.

As above mentioned, a video signal processing circuit 15 generates a data array conversion for inputting a video signal to a display device driver 200 and a synchronizing signal for driving each driver. As the present invention is characterized by controlling B/L luminance according to the inputted video signal, the video signal processing circuit 15 will be described in detail.

Figure 8:
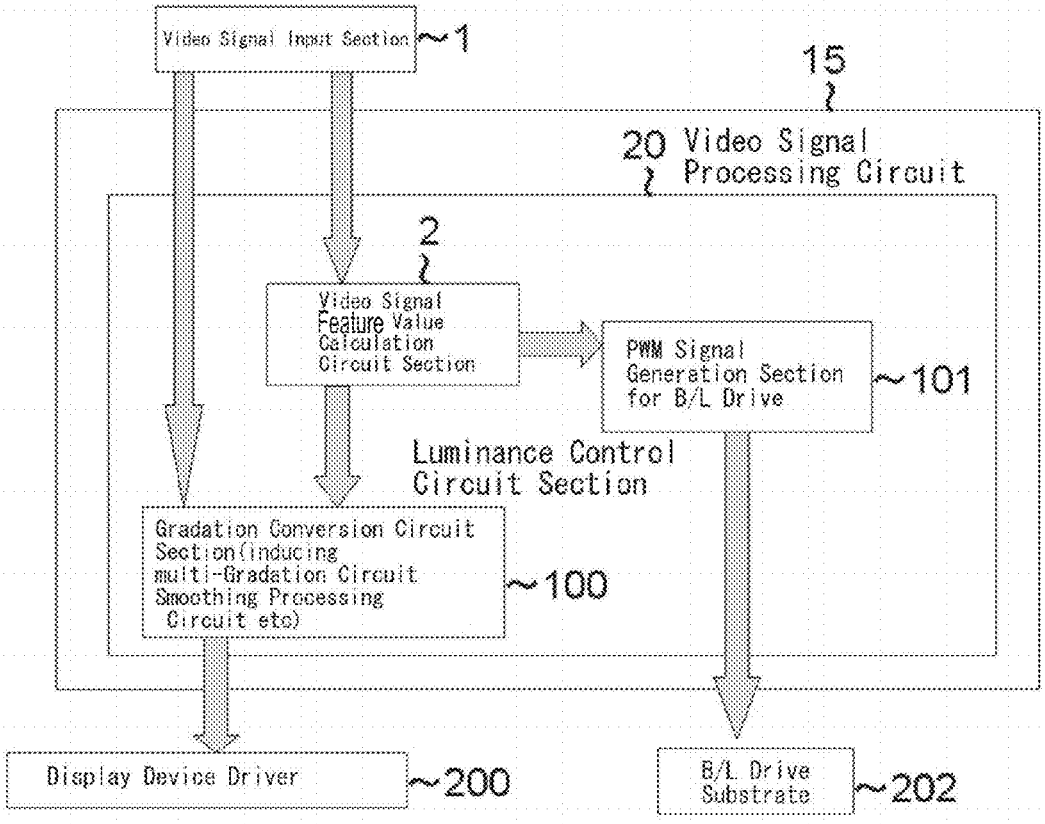
FIG. 8 is a view illustrating a peripheral circuit of a feature value calculation section of video signal in Embodiment 1 of the present invention.

FIG. 8 shows a luminance control circuit section 20 of the video signal processing circuit 15. A luminance control method will be described therewith. In addition, a number of gradation expression of video signal will be considered as 8 bit (the gradation value will be 0 to 255). The number of gradation expression is not limited to 8 bit, but may be 6 bit or 10 bit.

The luminance control circuit section 20 of the video signal processing circuit 15 is configured by a feature value calculation circuit section 2 of video signal, a gradation conversion circuit section 100, and PWM signal generation section for B/L drive 101 to input video signal from the video signal input section 1 and transmit the feature value calculation circuit 2 of video signal and the gradation conversion circuit section 100.

The feature value calculation circuit 2 of video signal is configured to calculate a feature value of video signal in one frame based on the inputted video signal. Herein, the feature value of video signal represents as one numerical value whether the video signal in one frame is wholly bright or wholly dark.

Based on this numerical value, an amount of reduction of B/L luminance is controlled to increase and save power consumption in case of wholly dark video signal and to decrease not to get worse the visibility of image quality in case of wholly bright video signal.

That is, the feature value of video signal is calculated. As a result, an amount of the reduction of B/L luminance will be determined.

The calculated feature value is transmitted to PWM signal generation section for B/L drive 101 to control the B/L luminance. A value of PWM is determined according to the calculated feature value and transmitted to a B/L drive substrate 202. Then, the luminance control is performed.

Concerning a method for controlling the B/L luminance, an amount of the reduction of luminance determined by the feature value of video signal is determined as PWM signal at the PWM signal generation section for B/L drive 101. The B/L luminance can be controlled by transmitting the PWM signal to the B/L drive substrate 202.

The whole video signal is darkened by this control method to deteriorate the visibility of image quality. The calculated feature value is, therefore, transmitted to the gradation conversion circuit section 100 as it is necessary to increase a higher gradation of video signal than the normal gradation thereof according to the luminance reduction.

Increasing the gradation only has to change the gamma characteristic. It has just to change the gamma characteristic with use of LUT (Look-up Table) or numerical expression.

In case of increasing the gradation, the resolution must be considered. Multi-gradation circuit or the like may be used or the smoothing procedure may be performed without an inflection point in the gamma characteristic.

The gradation conversion circuit section 100 determines the gradation conversion volume of the inputted video signal from the video signal input 1 according to the calculated feature value, transmits it to the display device driver after the gradation conversion (including multi-gradation, smoothing processing, or the like), and shows as video image.

Although the above description has been a fundamental circuit configuration and function thereof, the present invention is characterized in the video signal feature value calculation circuit 2. This calculation circuit will be described with reference to FIG. 1.

Figure 1:
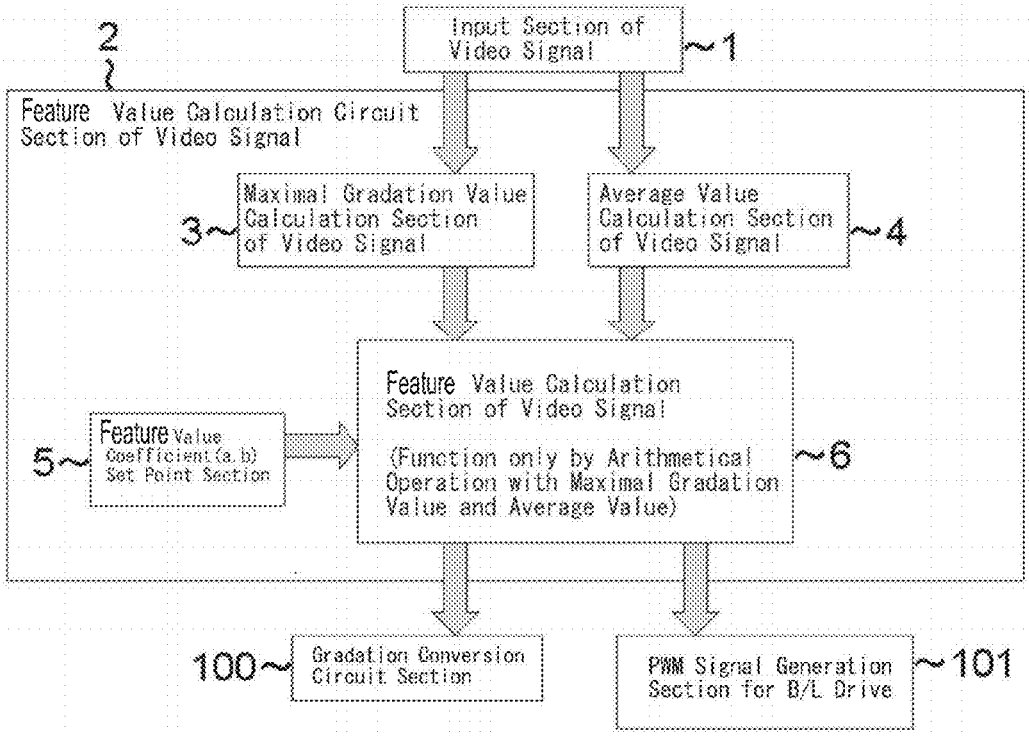
FIG. 1 is a view illustrating a feature value calculation circuit section of video signal in Embodiment 1 of the present invention.

FIG. 1 shows a block diagram of the feature value calculation circuit section 2 of the video signal. The feature value calculation circuit 2 of the video signal is comprised of a maximal gradation value calculation section 3 of the video signal, an average value calculation section 4 of the video signal, a feature coefficient (a, b) set point section 5, and a video signal feature value calculation section 6. An output of the input section of the video signal 1 connects to the feature value calculation circuit section 2 of video signal and the maximal gradation value calculation section 3 of video signal. Furthermore, an output of the feature value calculation section 6 of video signal is connected to a gradation conversion circuit 100 and a PWM signal generation section 101 for B/L drive.

First, the maximal value (MAX value) of gradation of video signal in one frame and the average value (AVE value) of gradation of video signal in one frame are calculated at the maximal gradation value calculation section 3 of the video signal in order to calculate the feature value (hereinafter, referred to as Rank value) of video signal in one frame from the video signal inputted based on the input section of video signal 1.

The Rank value is calculated by a function (the following equation (a)) of only arithmetical operation at the feature value calculation section 6 of the video signal with use of a value (a, b) predetermined at feature value coefficient (a, b) set point section 5, the MAX value, and the AVE value.

As described with FIG. 8, the calculated feature value is transmitted to the gradation conversion circuit section 100 and the PWM signal generation section for B/L drive 101. A configuration of the gradation conversion circuit section 100 and the PWM signal generation section for B/L drive 101 is the same as described in FIG. 8.

Figure 3:
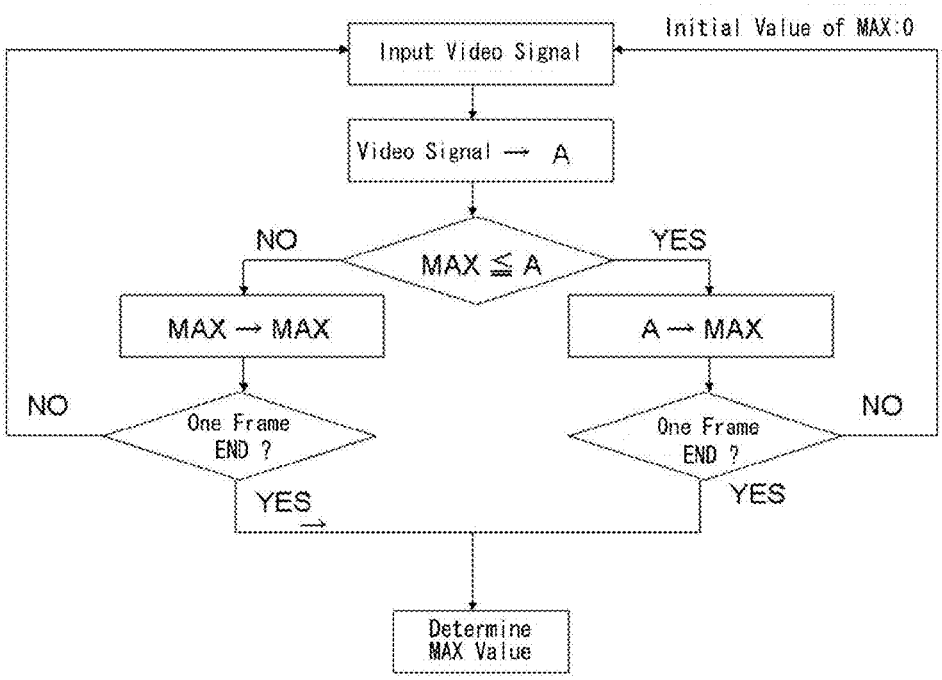
FIG. 3 is a view illustrating a calculation flowchart of maximal gradation value in Embodiment 1 of the present invention.

A calculation method of the MAX value will be described with reference to a flowchart in FIG. 3. At first, when the video signal at first pixel is inputted, it is stored in a Register named A and a value of the A and the MAX value are compared. In the above, as an initial value of the MAX value is zero, the video signal at first pixel is automatically set as the MAX value.

Next, when the video signal at second pixel is inputted, a value of the register A is renewed by data of the video signal at the second pixel, and the value of the Register A and the MAX value are compared. When a value of the Register A is more than or equal to MAX value, the MAX value is renewed. When a value of the Register A is less than MAX value, the MAX value will be the same value thereof.

Next, when the video signal at third pixel is inputted, a value of Register A is renewed by data of the video signal at third pixel. As well as the above, a value of Register A and the MAX value are compared each other. When a value of the Register A is more than or equal to the MAX value, the MAX value is renewed, and a value of Register A is less than MAX value, the MAX value will be the same value thereof.

By a repetition of these procedures is performed during effective period of data in one frame, the MAX value of video signal in one frame can be calculated.

There are three kinds of RGB data per one pixel in the video signal. In case of calculating the MAX value of RGB, in accordance with the comparison of a size of R, G, and B, the largest data among them may be considered or treated as data at first pixel.

Figure 4:
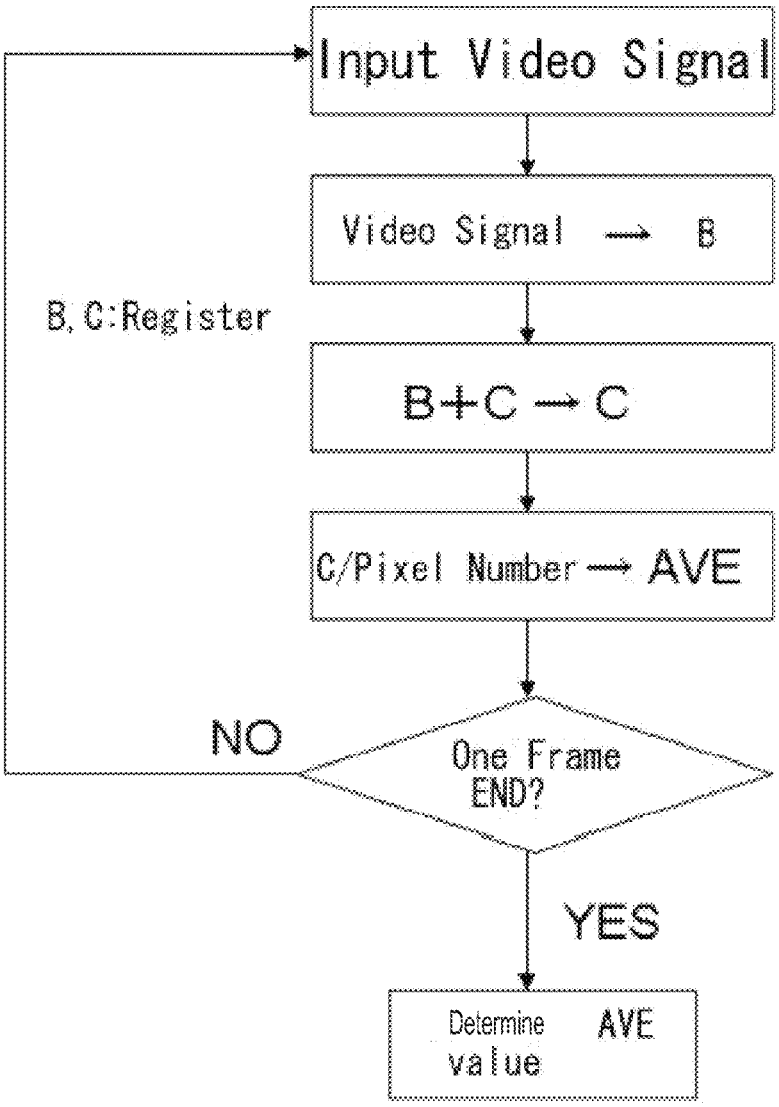
FIG. 4 is a view illustrating the calculation flowchart of the average value in Embodiment 1 of the present invention.

Next, a calculation method of AVE value will be described with reference to FIG. 4. When data at first pixel is inputted, data of the first pixel is stored in a Register named B. Next, an addition of a value of B and a value of C (an initial value of C is zero) is stored in a Register named C (an initial value of C is renewed). Next, a value of C is divided by a total number of all panel pixels in display device to be considered as AVE value. The total number of whole panel pixels is determined by the panel. Then, the total number is previously predetermined. A repetition of these procedures is performed during an effective period of data in one frame.

For example, when the video signal at second pixel is inputted, the data of the second pixel is stored in Register B. As the data of the first pixel is stored in Register C, the Register C is renewed by addition of the first pixel data and the second pixel data.

In case where the total number of pixels are n (n is a natural number) pieces of panels, when data of the n-th pixel is inputted into the video signal, data at n-th pixel is stored in the Register B. At this point, as a sum of data added from first pixel to (n-1)-th pixel is stored in Register C, the Register C is renewed by an addition of the n-th pixel and the sum added from the first pixel to (n-1)-th pixel.

The Register C is data added from the first pixel to the n-th pixel which is last pixel. AVE value is obtained by dividing data in the Register C by a number of n, as the number of pixels is n.

Although there are three kinds of data per one pixel in the video signal, the video signal may be considered or treated as one pixel data by adding three kinds of data. In this case, it must be required for three times of the number of pixels.

One pixel is configured by three kinds of sub-pixels of RGB. It will be described in detail with reference to FIGS. 5A and 5B, considering the sub-pixel.

Figure 5A:
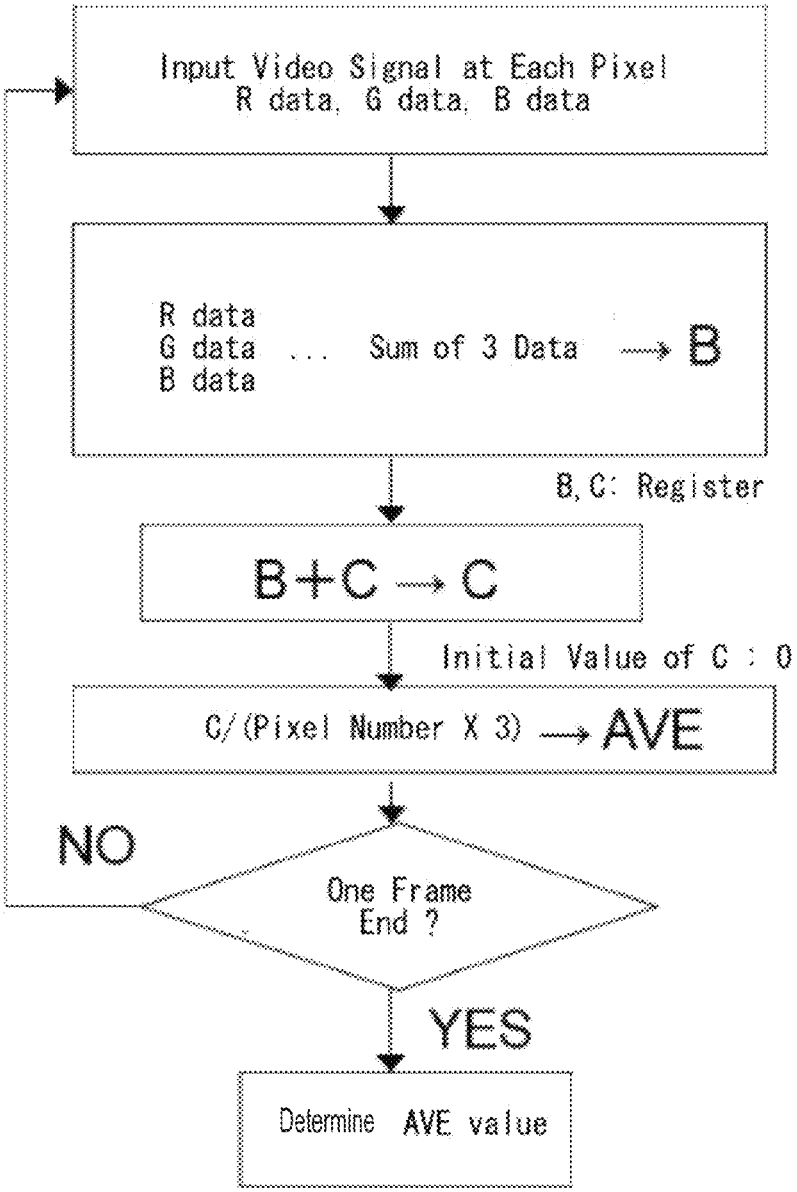
FIG. 5A is a view illustrating the calculation flowchart of the average value in consideration of RGB sub-pixel in Embodiment 1 of the present invention to show a calculation method of the average value of all of the sub-pixels.

As the above-mentioned calculation method, FIG. 5A shows an average value calculation method of all sub-pixels. There are three sub-pixels of RGB in one pixel. In case where a sum of R data, G data, and B data of the inputted video signal are respectively entered in the Register B and sequentially added in the Register C, it is necessary to divide the data in the Register C by the total numbers (in this case, the total number of pixels) for calculation of the average value. Thus, as the total number of sub-pixels of all screens is equal to 3 times of the number of pixels, the value in the Register C may be divided by a product of a number of pixels and three.

Figure 5B:
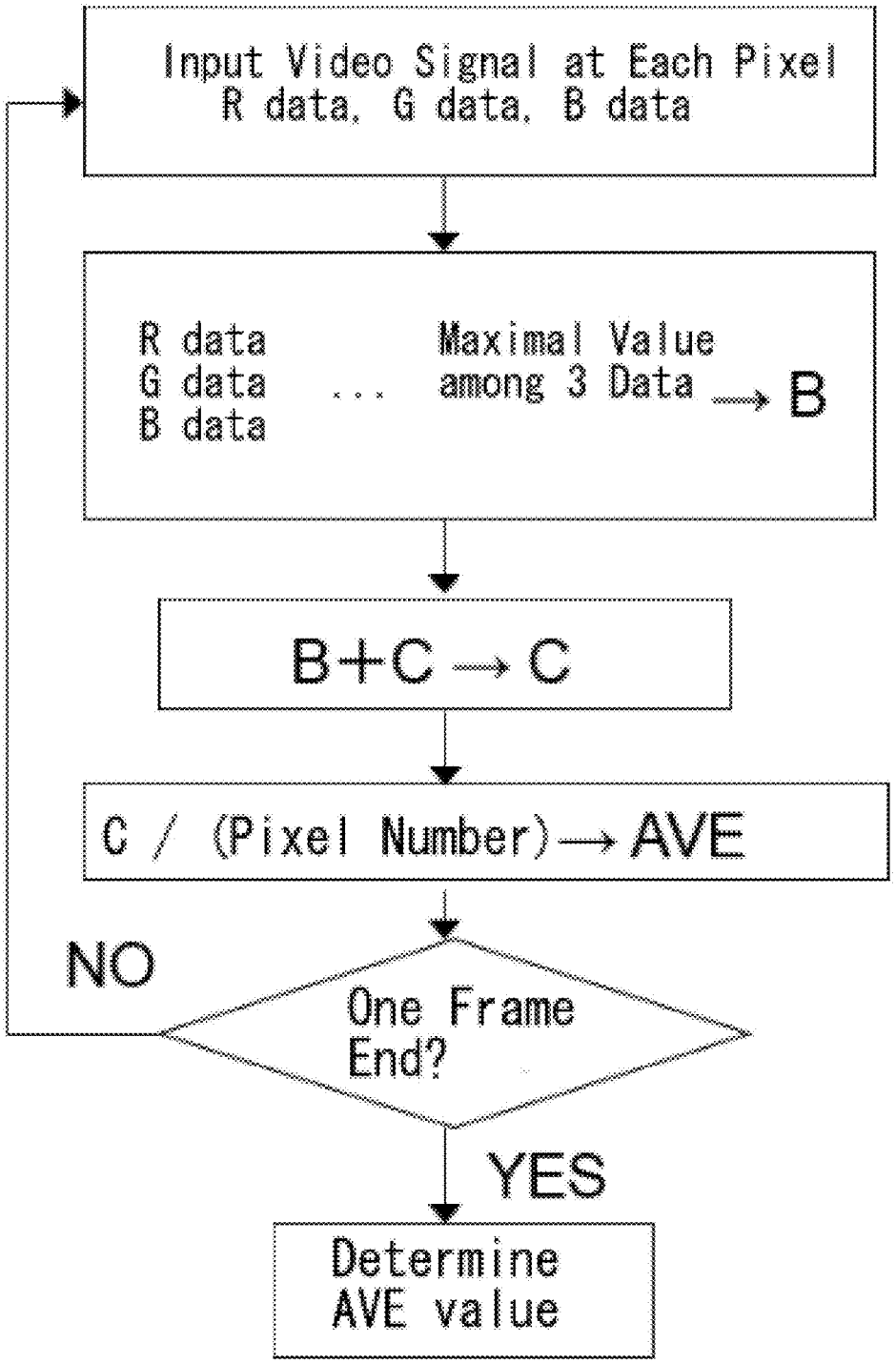
FIG. 5B is a view illustrating the calculation flowchart of the average value in consideration of RGB sub-pixel in Embodiment 1 of the present invention to show a calculation method of the average value of maximal values of the sub-pixels.
Figure 6A:
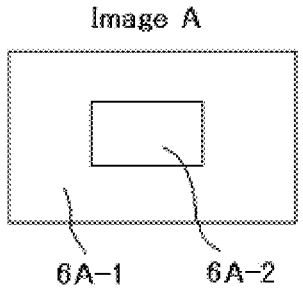
FIG. 6A, 6B, 6C, and 6D are views illustrating a calculation example of the feature value with a histogram in Embodiment 1 of the present invention.
Figure 6B:
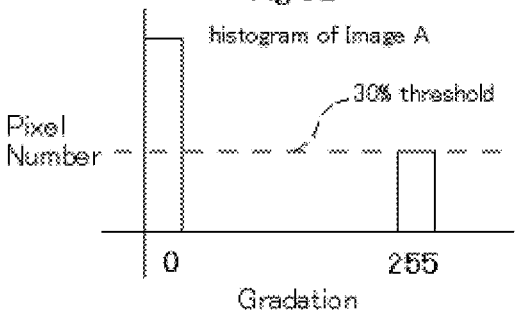
Figure 6C:
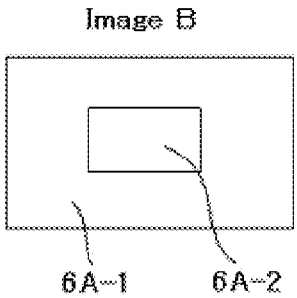
Figure 6D:
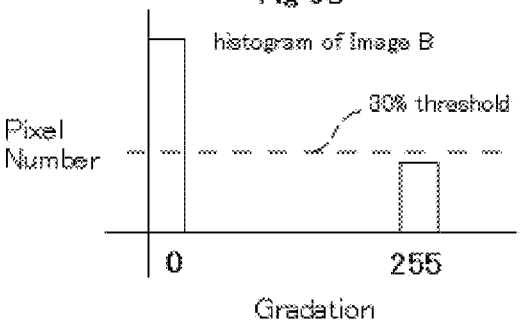

As another calculation method of the average value, FIG. 5B shows an average value calculation method of maximal value in sub-pixel.

The above method is a method taking a maximal value in three sub-pixels, entering into the Register B as a maximal value of one pixel, and sequentially adding to the Register C. As the maximal value in the three sub-pixels is used in this case, the number of pixels is one piece per one pixel and the number for dividing is equal to the number of pixels in order to calculate an average value.

Although two methods for calculating the AVE value have been described, the feature value of each calculation method will be followed. In case of the average value calculation method of all sub-pixels in FIG. 5A, as an average value may be relatively small, it is useful to prioritize a reduction of power composition. In case of the average value calculation method of the maximal value of sub-pixels in FIG. 5B, as the average value may be relatively large, it is useful to prioritize an image quality (luminance). Either method can be properly used according to the use, in particular, its priority.

Using the above MAX value and AVE value, the Rank value can be calculated according to the following equation (a).

$$\text{Rank}=(a/p)\times(1-(b/q)\times\text{AVE})\times\text{AVE}+(1-(a/p)\times(1-(b/q)\times\text{AVE}))\times\text{MAX} \quad \text{(a)}$$

Where a, b, p and q: any coefficient

It will be understood by an expansion of the equation (a) that the above equation is configured by a polynomial comprising the following four members.

1 a member multiplying a coefficient by a square of AVE value 2 a member multiplying a coefficient by AVE value 3 a member multiplying a coefficient by MAX value 4 a member multiplying a coefficient by a product of AVE value and MAX value The present invention is characterized in that the feature value of video signal is a value calculated by the above equation (a).

The PWM value of actual PWM signal generates by the following equation with use of Rank value.

$$PWM=(\text{Rank}/f(n))\hat{}2.2 \quad \text{(b)}$$

Where f(n): maximal display gradation value (255 as described by 8 bit in case of the present invention)

As shown in FIG. 8, the gamma conversion for supplement of the amount of the luminous reduction is performed after the Rank value is sent to the gradation conversion circuit section 100. The video signal outputted from the gradation conversion circuit section 100 is transmitted to the display device driver in accordance with the predetermined transmission format.

Figure 2:
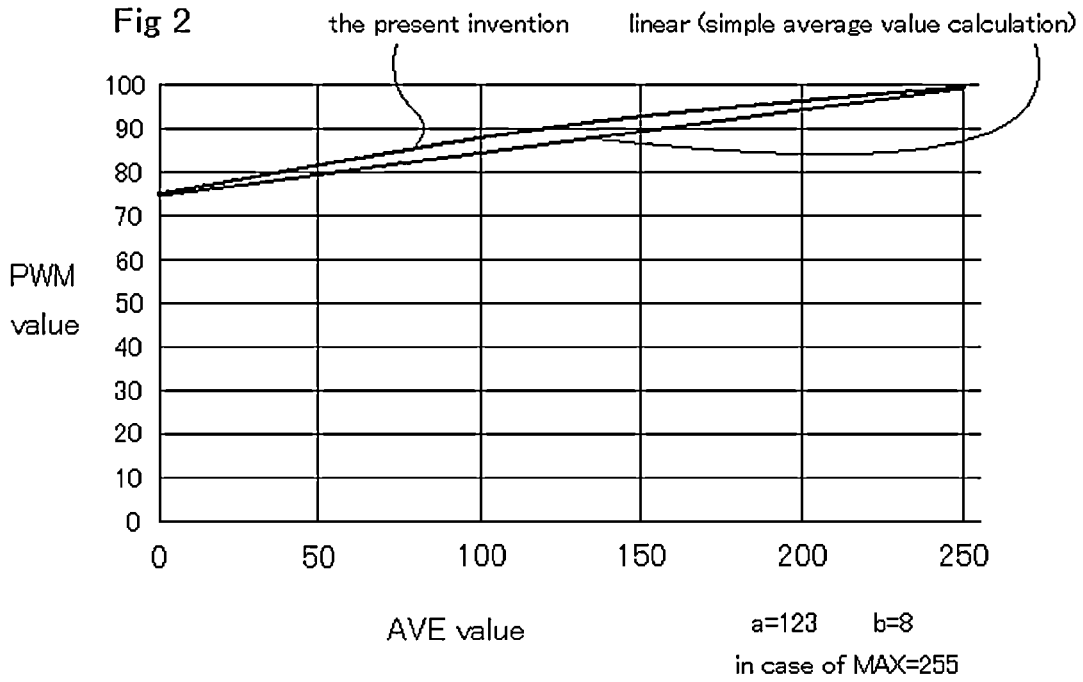
FIG. 2 is a view illustrating a feature value change relative to an average value of the video signal in Embodiment 1 of the present invention.

The above-mentioned equation (a) will be described in detail with use of FIG. 2. FIG. 2 shows the equation (a) as graph with the AVE value in a horizontal axis and with the PWM value in vertical axis. Any coefficients a and b are set as a=123 and b=8, respectively. These values a and b were respectively appropriate values upon the confirmation of image quality.

The values of any coefficients p and q are determined as p=1024 and q=4096, respectively. These values p and q are coefficients used for dividing values of the coefficients a and b, respectively. The small circuit scale can be obtained by simplification of calculation with use of a value of n-th power of two.

Furthermore, the set points of this p=1024 and q=4096 are, respectively, appropriate values when the AVE value and MAX value are calculated by the resolution of 8 bit. For example, in case where the resolution of AVE value and MAX value is 10 bit, p=1024 and q=16384 will be appropriate values. The values of p and q may be, respectively, determined as appropriate values according to the resolution of the AVE value and the MAX value.

The graph described as "linear" in FIG. 2 is a graph of the Rank value generated by the polynomial configured by only members of the MAX value and the AVE value for comparison.

It can be understood that this linear graph is larger in a rate of luminance reduction at high gradation side relative to a graph of the present invention, as the linear graph reduces the PWM value at a constant rate. It also can be understood that the linear graph is the same as one graph of b=0 at equation (a).

The present invention is characterized in that the graph of the present invention is curved upward, like a shape of convex, relative to the linear graph by setting a value of b as at least one, is configured to reduce the luminance reduction at higher gradation side relative to the luminance reduction of the linear graph, and is designed to eliminate a discomfort of image quality even at a screen with many of high gradation. (Of course, b=0 can be set).

The linear graph is described for a criterion of comparison. Although it is required that the Rank value is strictly calculated as b=0 at Equation (a) according to the AVE value and the MAX value and the PWM value is calculated, the calculation will be omitted. An actual operation gives priority to a numerical expression relative to a graph. It is important that the Rank value obtained by the equation (a) of the present invention is more than or equal to the Rank value (linear function of the AVE value) obtained at the time of b=0 in the equation (a). This fact is always established in case where values of a, p, q, AVE, and MAX are more than zero. Where values of a, AVE and MAX may be zero.

When the above matter will be specifically described, the Rank value will be the following in the equation (a).

$$\text{Rank}=(a/p)\times\text{AVE}+(1-(a/p))\times\text{MAX} \tag{8}$$

To develop the equation (a) will be the following.

$$\text{Rank}=(a/p)\times\text{AVE}+(1-(a/p))\times\text{MAX}+((a/p)\times(b/q)\times\text{AVE})\times(\text{MAX}-\text{AVE}) \tag{9}$$

The above equation (9) is to add the underlined part to the Rank value at the time of b=0.

As members (a/p), (b/p), AVE, and (MAX−AVE) at the underlined part in equation (9) are always values to be more than or equal to zero, the average value never becomes a value to be more than or equal to the maximal value. When a value of multiplication among these values is added thereto, it can be understood that it is always a value to be more than or equal to the Rank value at the time of b=0. As a relationship between the Rank value of (b) and PWM is a monotonic increase at all times, it can be understood that it becomes constantly a value to be more than or equal to PWM value calculated based on the Rank value obtained at the time of b=0.

In case where the luminance change of B/L is compared with an amount of luminance reduction calculated by the feature value generated by a linear function of the average value and maximal value in one frame of the inputted video signal, it is controlled to be always an amount of luminance reduction, which is less than or equal to an amount of the luminance reduction calculated by the linear function.

Specifically, in case where the luminance change of B/L is illustrated as a graph in FIG. 2, with a vertical axis to be PWM value and with a horizontal axis to be AVE value, it is controlled to be constantly curved upward (like a shape of convex) relative to a linear function shown by a first-degree polynomial function. Such control of a reduction of luminance is characterized by eliminating discomfort of image quality even in an image with much high gradation.

When the video signal including many of high gradation is inputted, the image seems to be dark by increasing a reduction of luminance. This is on the ground that the gradation may only be changed up to 255 when the gradation value of the inputted video signal exists near the maximal gradation value.

Though approximately 10 percentage of luminance is increased by changing the gradation ranging from 243th gradation to 255th gradation, only 5 percentage of luminance can be increased by changing the gradation ranging from 249th gradation to 255th gradation. In case of converting the gradation ranging from 254th gradation to 255th gradation, an increasing amount of luminance is about 1 percentage. Thus, in case when 255th gradation is inputted, the gradation cannot be converted for increasing the luminance.

Even if an amount of luminance reduction is 10 percentage, there is no way to supply 10 percentage by gradation conversion at the time of input of the gradation over 243th gradation. Then, the luminance in the pixel simply reduces. The image including high gradation means a total number of pixels in the high gradation. As a result, the whole image seems to be dark.

When the image is explained as one example, an image with many of low gradation appear in a natural view such as a night view, a cloudy outdoors, and indoors may be often that the AVE value is about 50 to 70. (AVE value presupposes 255)

An image with many of middle gradation often appears in a natural view such as shiny outdoors, plants, and fruits. The AVE value of the image with many of middle gradation is about 100 to 120. An image with many of high gradation often appears in a natural view such as an image showing and zooming white clothes, white plates and blue sky with clouds of the daytime. The AVE value of the image with many of high gradation is more than or equal to 180.

When the video signal including many of high gradation is inputted, the luminance reduction must be small in order not to generate a discomfort of image quality On the other hand, when the video signal including many of low gradation is inputted, the gradation of many pixels can be converted. Thus, it can be a large luminance reduction. The image of high gradation may only be converted up to 255th gradation as well. As the total number of images including high gradation is small, it does not seem to be dark.

On the other hand, although problems of conventional arts have been described, a calculation method using the histogram will be described as another example of the feature value calculation method. There is a problem in which the luminance changes discontinuously in case of using the histogram.

As shown in FIGS. 6A, 6B, 6C and 6D, the feature value of the video signal sets a value corresponding to the gradation value, which counts from the maximal gradation value of the histogram, and falls under third tens of the total numbers. In this case, the Image A shows 30 percentage of white window (255th gradation) in the black image (0 gradation) and the Image B shows a 29 percentage of white window (255th gradation) in the black image (0 gradation).

In comparison with the Image A and B, there is little or no apparent difference therebetween. When the feature value of the video signal setting a luminance reduction of B/L is, however, set based on the histogram of the video signal in one frame, the gradation in the image A, which counts from a maximal gradation and falls under 30 percentage of the total number, is 255th gradation, and the gradation in the Image B, which counts from the maximal gradation and falls under 30 percentage of the total number, is 0 gradation.

The Image A is an amount of luminance reduction based on 255th gradation, and the Image B is an amount of luminance reduction based on 0 gradation. Original images of the Image A and B become a large difference in an amount of luminance reduction in spite of little or no difference therebetween.

Figure 7:
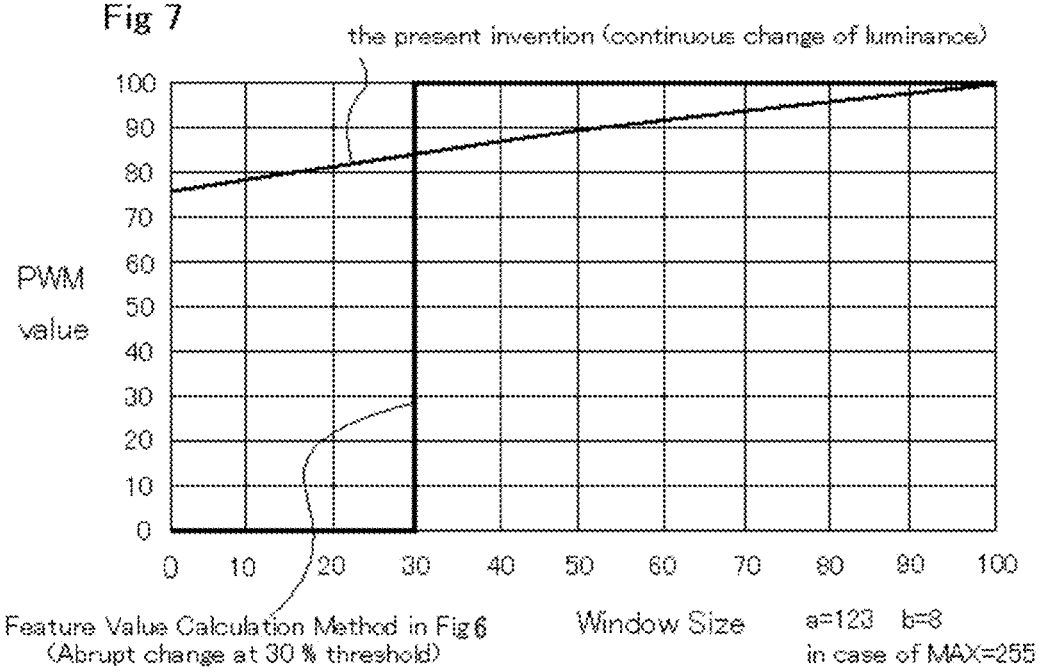
FIG. 7 is a view illustrating B/L luminance change in a window area of the video signal in Embodiment 1 of the present invention.

FIG. 7 shows a relationship between this window size and the luminance. At first, in case where the video signal representing all white is inputted, the window size is supposed to be 100 percentage.

Next, the window size (all white) is gradually reducing. For example, in case where the window size is supposed to be 30 percentage, an amount of luminance reduction is zero percentage because of the luminance reduction based on the 255th gradation.

Next, in case where the window size (all white area) is supposed to be 29 percentage thereof, an amount of the luminance reduction becomes 100 percentage because of the luminance reduction based on zero gradation. Then, the luminance becomes dark suddenly.

When the luminance changes slightly and suddenly by a change of the video signal, a discomfort in image quality comes to appear. Specifically, when the image A is changed to the image B, the luminance of the white window seems to become dark suddenly.

As shown in FIG. 7, according to the present invention, there is no abrupt change of luminance even in case of continuous change of the window size. It can be seen that the luminance changes continuously.

Specifically, the relationship between the inputted video signal and the luminance change of B/L will be described. According to the present invention, all white is inputted as the video signal, and a pixel of black is displayed in any screen area from all white screen condition. In case where the rate of black screen area is gradually increasing and the while screen area changes the video signal continuously up to one pixel, the luminance of B/L is continuously reducing from the all white screen up to one pixel of white and the luminance does not change suddenly by a slight change of the video signal.

There is no inflection point in any part of luminance change by using the equation (a). Even if the feature value changes a little by a subtle change of image, the luminance does not change suddenly and the luminance changes continuously and smoothly. As a result, a discomfort in image quality can be prevented.

In addition, it is not required to put on the B/L at the time of all black screen. An amount of the luminance reduction becomes 100 percentage (lighting-off) according to the present invention. This can be understood by the equation (a).

As above described, as the CABC control is performed with use of the feature value calculated with the equation (a), it is possible to obtain the low power consumption in no discomfort in image quality. As an example of discomfort, luminance changes suddenly by a slight change of the inputted video signal, and it appears to be wholly dark in case of input video signal including many of high gradation.

(Embodiment 2)

Figure 10:
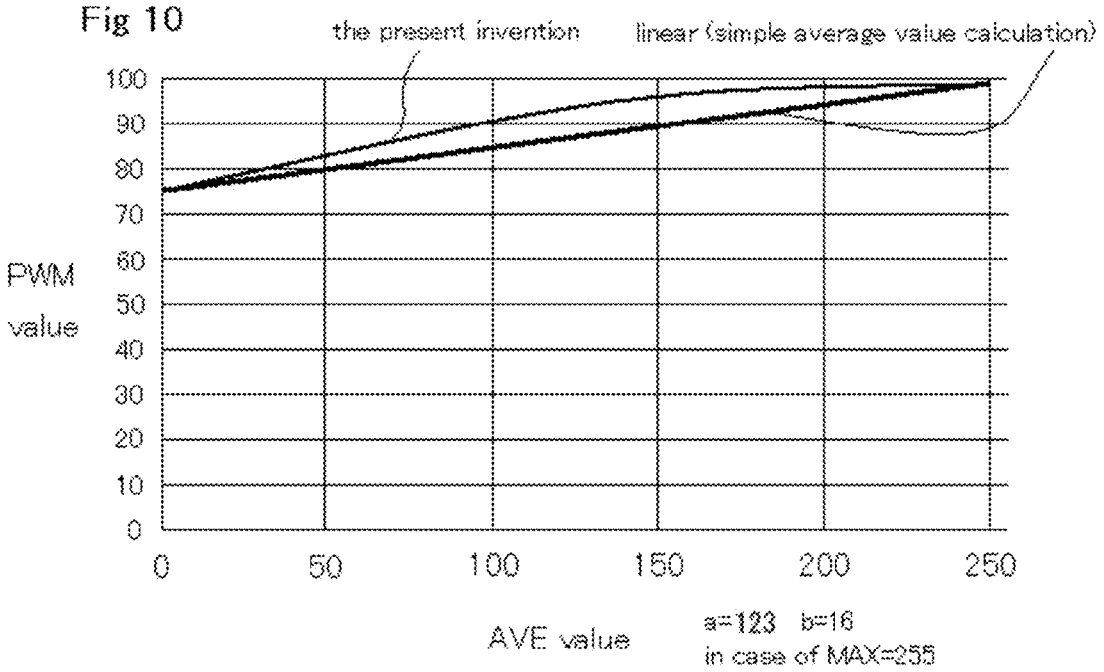
FIG. 10 is a view illustrating the feature value change relative to the average value of the video signal in Embodiment 2 of the present invention.

Embodiment 2 describes a method for setting a value of any coefficient b, which has been described in Embodiment 1. For example, a characteristic shown in FIG. 10 can be obtained by setting b as 16 (b=16).

This is effective when the visibility keeps good in case of an image with many of high gradation. For example, it is an effective setting in case where the luminance falls in a bright image such as originally low B/L luminance.

Considering the Embodiment 1, a value of coefficient b may be set in the range of values 1 to 31. Although it is a linear shape in case of b=0, it may be set as b=0.

When a value of the b increases, the PWM value may exceed 100 percentage from an AVE value. The ill effects owing to the above may be avoided by limiting a value of the AVE, which exceeds the AVE value, by limiter (consider or treat as 100 percentage in case of exceeding 100 percentage).

The setting method may be stored in the Register IC as b=8 in the product A and as b=16 in the product B, or a value of setting may be modified with use of an external ROM.

Embodiment 2 is the same configuration and operation as Embodiment 1 except the setting method of the coefficient b in this Embodiment.

(Embodiment 3)

Figure 11:
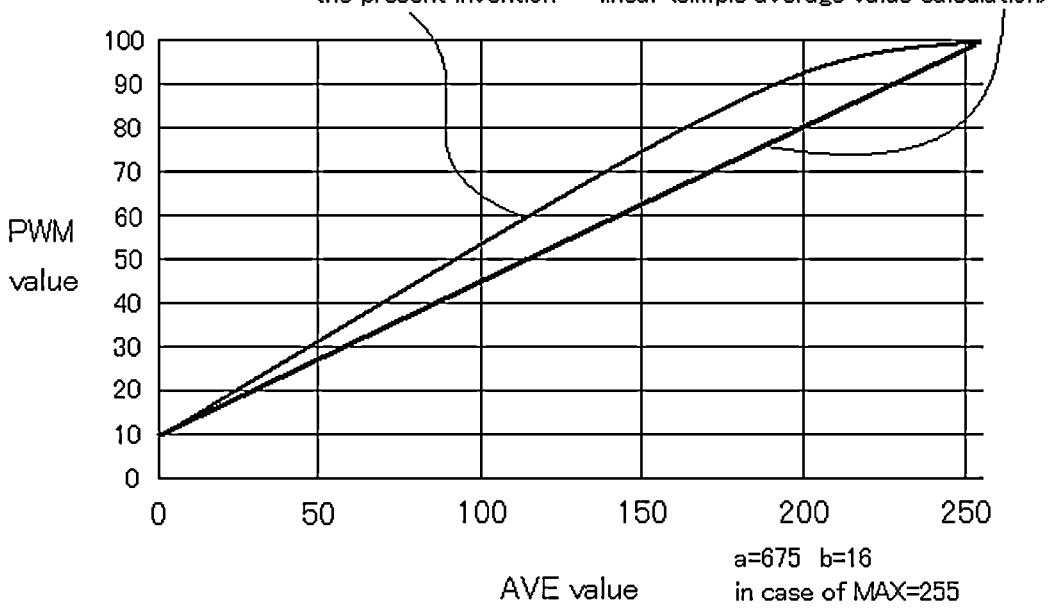
FIG. 11 is a view illustrating the feature value change relative to the average value of the video signal in Embodiment 3 of the present invention.

In Embodiment 3, a setting method of coefficient a described in Embodiment 1 will be described. For example, the characteristic in FIG. 11 will be obtained in case of setting as a=675.

This is effective in case where it is aimed at low power consumption in a screen with many of low gradation. As described in Embodiment 1, an image having many of low gradation, that is, dark image is about 50 to 70 in AVE value. (in case of 8-bit input)

Under these situations, it is possible to determine a target value of PWM and determine a coefficient a. For example, PWM value is 30 percentage around 50 of AVE value in FIG. 11.

When it is too dark, the PWM value can be increased upon determining a value of the a to be a little smaller. These can be determined considering the image quality.

Considering Embodiment 1, the coefficient a can be determined in the range of 1 to 1024. According to the setting method, the coefficient a such as a=123 in the product A and a=675 in the product B can be designed to store in the Register IC or change the set point with use of an external ROM.

This Embodiment is the same configuration and operation as the Embodiment 1 except the setting method of coefficient a in this Embodiment.

(Embodiment 4)

In Embodiment 4, a circuit linking any coefficient b described in Embodiment 1 and the MAX value will be described. For example, as described in Embodiment 1, the characteristic in FIG. 2 will be obtained upon setting coefficients (a,b)=(123,8). This is supposed to be 255 in MAX value.

Considering image such as a common natural image, it can be seen a lot that the high gradation (around 255th gradation) is contained in one part of wholly dark screen. However, as it may be seen that the MAX value is not 255, but 220 or 200, these situations must be took into consideration.

Figure 12:
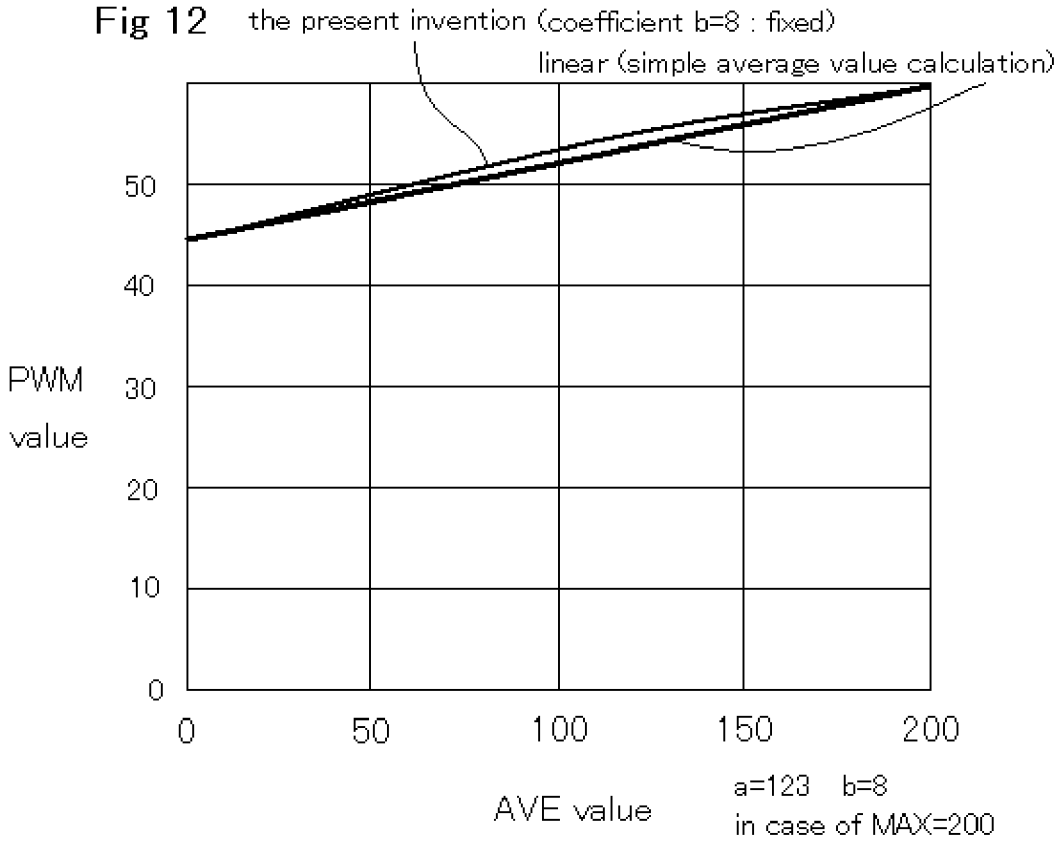
FIG. 12 is a view illustrating the feature value change relative to the average value of the video signal in Embodiment 4 of the present invention.

FIG. 12 illustrates a graph in case where the MAX value is not 255 but 200, upon determining coefficients (a,b)=(123, 8) described in Embodiment 1. It can be understood that the luminance in the side of high gradation reduces in comparison with FIG. 2.

In case where the MAX value is smaller than 255, it is possible that the luminance reduction can be prevented in the side of high gradation, as shown in FIG. 2, by controlling the variation of the coefficient b in linkage with the MAX value.

Figure 13:
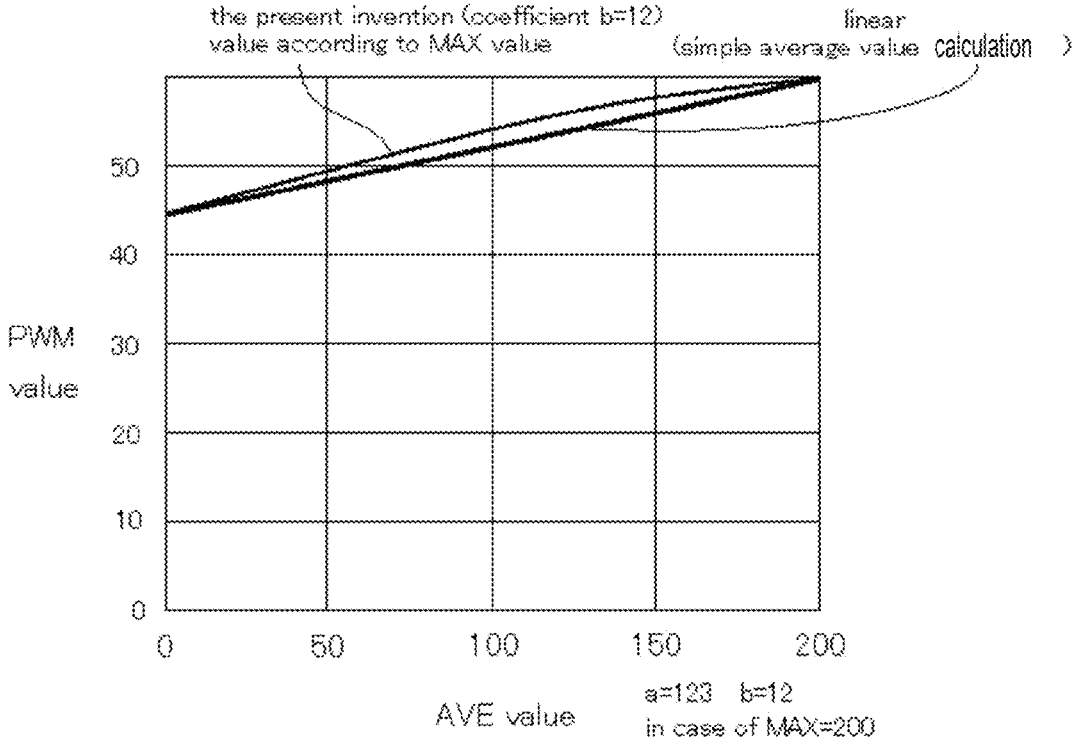
FIG. 13 is a view illustrating the feature value change relative to the average value of the video signal in Embodiment 4 of the present invention.

For example, FIG. 13 illustrates a graph when b=12 is set in case of the MAX value=200. Comparing this graph with the graph in FIG. 2, the luminance reduction in the side of high gradation can be prevented at almost the same rate.

That is, it may be only controlled such that the coefficients are (a,b)=(123,8) in case of MAX value=255 and the coefficients are (a,b)=(123,12) in case of MAX value=200.

In case where the above-mentioned MAX value changes, an equation of the relationship considering the coefficient b as a best value will be described in the following.

$$b_m=(255/c)\times(f(n)/\mathrm{MAX})\times b \quad \text{(c)}$$

where

- b: value of any coefficient b set at the time of 255 in MAX value
- c: any coefficient
- MAX: maximal value of gradation of video signal in one frame
- f(n): maximal display gradation value(255 in case of 8 bit)

More specifically, for example, when the coefficients (a,b) are set as (123,8) in case of 255 in MAX value, any coefficient c in the equation (c) is set as 216 and the coefficient (b) obtained by the equation (c) at the time of 200 in MAX value will be 12. As a result, it can be seen that the coefficients (a,b)=(123,8) at the time of 255 in MAX value and the coefficients (a,b)=(123,12) at the time of 200 in MAX value can be obtained, respectively.

Next, a calculation formula calculating the Rank value can be calculated by the following equation (d).

$$\mathrm{Rank}=(a/p)\times(1-(b_m/q)\times\mathrm{AVE})\times\mathrm{AVE}+(1-(a/p)\times(1-(b_m/q)\times\mathrm{AVE}))\times\mathrm{MAX} \quad \text{(d)}$$

Where

- a: any coefficient
- b_m: coefficient b obtained by the equation (c)
- p: any coefficient
- q: any coefficient
- MAX: maximal value of gradation of video signal in one frame
- AVE: average value of gradation of video signal in one frame Although the coefficient (b) in the equation (a) is different from the coefficient (b_m) in the equation (d), the value of the coefficient (b_m) is a value used for easy understanding of the calculation in Embodiment 4. Actually, a value of b is renewed by the equation (c).

Accordingly, two equations of the equations (a) and (d) are not required, but only the equation (a) may be. Thus, only the equation (c) may be appended in the control circuit in Embodiment 1 in order to operate the control circuit in Embodiment 4.

As well as Embodiment 1, any of coefficients p and q are set to be p=1024 and q=4096, respectively. These set points p and q are appropriate values, upon calculating the AVE value and the MAX value by 8-bit resolution. As the resolutions of AVE value and MAX value increase, values p and q may be accordingly set by calculating an appropriate value.

Upon changing the MAX value by controlling a value b with use of the equation (c), it is possible to become a small discomfort in image quality, which feels like being wholly dark in case of the inputted video signal containing many of high gradation.

As the configuration of the present embodiment is the same as the luminance control circuit section 20 of the video signal processing circuit 15 illustrated in FIG. 8 of Embodiment 1, the feature value calculation circuit section 2 of the video signal will be described in detail.

Figure 14:
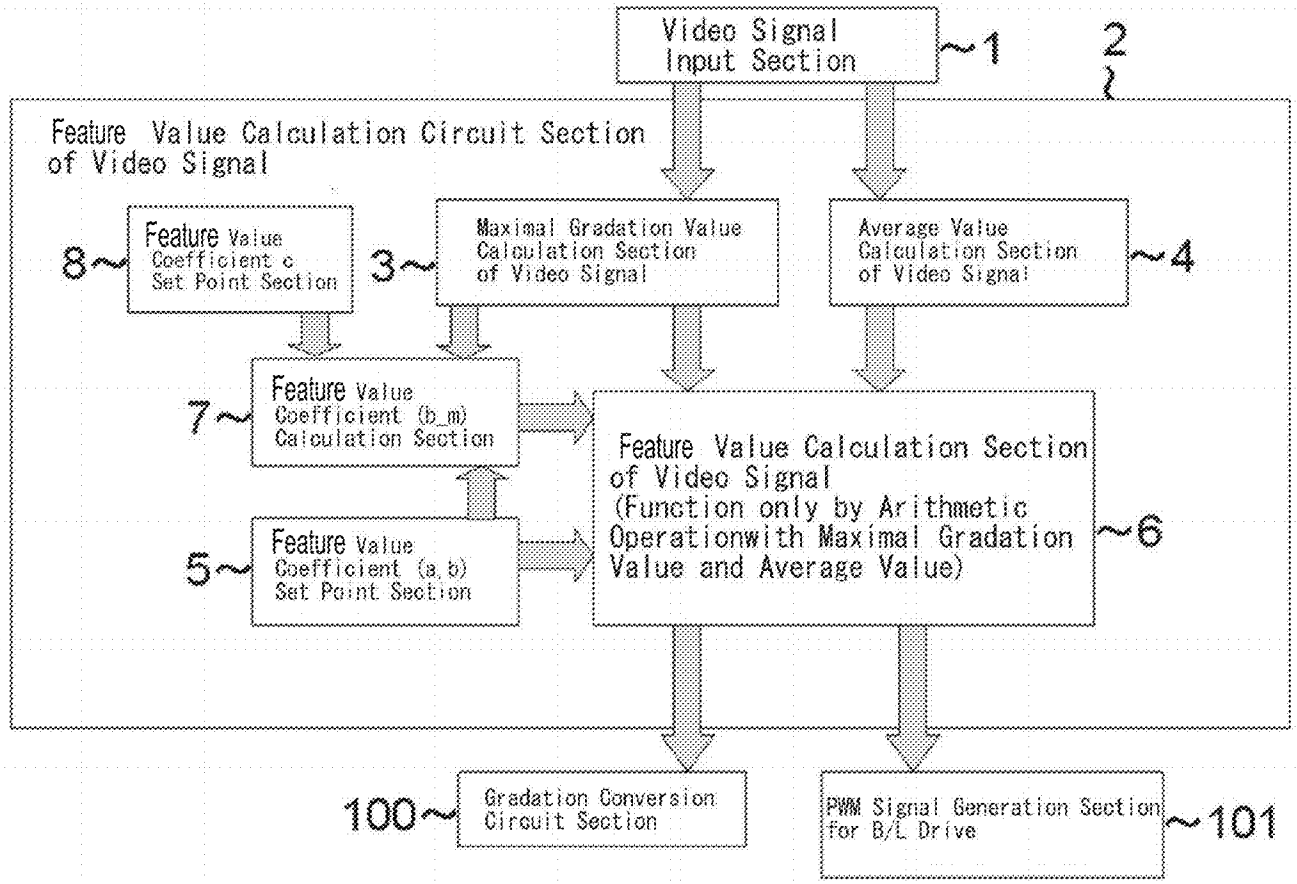
FIG. 14 is a view illustrating the feature value calculation circuit section of video signal in Embodiment 4 of the present invention.

FIG. 14 illustrates a configuration of the feature value calculation circuit section 2 of the video signal. The sections, which are different from Embodiment 1, are configured by appending a feature value coefficient (b_m) calculation section 7 and a feature value coefficient c set point section 8 illustrated in FIG. 14.

The feature value calculation circuit section 2 of the video signal is configured by a maximal gradation value calculation section 3 of the video signal, an average value calculation section 4 of the video signal, a feature value coefficient (a,b) set point section 5, the feature value calculation section 6 of the video signal, the feature value coefficient (b_m) calculation section 7, and the feature value coefficient c set point section 8.

At first, a video signal is inputted from the feature value calculation circuit 2 of the video signal, the maximal value (MAX value) of the video signal in one frame is calculated at the maximal gradation value calculation section 3 of the video signal, and the average value (AVE value) of the video signal in one frame is calculated at the average value calculation section 4 of the video signal.

At the feature value coefficient (b_m) calculation section 7, the coefficient (b_m) can be calculated by the equation (c) in Embodiment 4, with use of the MAX value calculated at the maximal gradation value calculation section 3 of the video signal, the coefficient b predetermined at the feature value coefficient (a,b) set point section 5, and the coefficient c predetermined at the feature value coefficient c set point section 8.

Next, in the feature value calculation section 6 of the video signal, the Rank value can be calculated by a function used by an arithmetic operation shown by the equation (d) in Embodiment 4, with use of the coefficient a predetermined at the feature value coefficient (a,b) set point section 5, coefficient b_m calculated by the feature value coefficient (b_m) calculation section 7, the MAX value and the AVE value.

The calculated feature value, as described with reference to FIG. 8, is transmitted to the gradation conversion circuit section 100 and the PWM signal generation section for B/L drive 101. Further configurations extending from the gradation conversion circuit section 100 and the PWM signal generation section for B/L drive 101 is the same as configurations described in FIG. 8.

Finally, an operation of this Embodiment will be described. This Embodiment is characterized by controlling any coefficient b described in Embodiment 1 according to the MAX value. The other operation is the same as one of Embodiment 1.

Each circuit block for controlling the B/L luminance according to the inputted video signal will be described with reference to FIG. 8 and FIG. 14.

As shown in FIG. 13, the video signal is inputted to calculate the maximal gradation value (MAX) in one frame and the average value (AVE) of the video signal.

Next, the coefficient b is calculated by the following equation (c) based on the calculated MAX value.

$$b_m=(255/c)\times(f(n)/\mathrm{MAX})\times b \quad (c)$$

where b: value of any coefficient b set at the time of 255 in MAX value c: any coefficient MAX: maximal value of gradation of video signal in one frame f(n): maximal display gradation value(255 in case of 8 bit)

The Rank value is calculated by the following equation (d) with use of the calculated MAX value and the calculated AVE value and the coefficients a and b_m.

The equation (d) is supposed to replace the coefficient b in the equation (a) by the coefficient b_m. In an actual control circuit, the equation for calculating the feature value may be the equation (a), as the coefficient b is renewed by the equation (c). The coefficient b_m can be used for easy understanding of the equation.

$$\mathrm{Rank}=(a/p)\times(1-(b_m/q)\times\mathrm{AVE})\times\mathrm{AVE}+(1-(a/p)\times(1-(b_m/q)\times\mathrm{AVE}))\times\mathrm{MAX} \quad (d)$$

where a: any coefficient b_m: coefficient obtained by the equation (c)

p: any coefficient q: any coefficient

MAX: maximal value of gradation of video signal in one frame

AVE: average value of gradation of video signal in one frame

Any coefficient c in the equation (c) may be set in the range of 1 to 254. In particular, the coefficient c(=216) is an appropriate value upon confirming the image quality.

The value c is set to make small, the value b_m may be beyond 31. The procedure for limiting it at a boundary value, that is, coefficient b_m beginning to go beyond 31 (31 in case of going beyond 31) and the like can be performed.

A method for setting the value c may be designed to store in the Register IC or change the set point with use of the external ROM.

Next, as shown in FIG. 7, the PWM signal for reducing the B/L luminance with use of the calculated Rank value is generated at PWM signal generation section based on the equation (b). Then, the generated PWM signal is transmitted to the B/L drive substrate 202.

$$PWM=(\mathrm{Rank}/f(n))\hat{}2.2 \quad (b)$$

f(n): maximal display gradation value(255 in case of 8 bit)

Rank: the feature value of video signal in one frame

On the other hand, the gradation conversion is performed at the gradation conversion circuit section as shown in FIG. 8 in order to perform the gamma conversion for complementing the luminance reduction. The video signal outputted from the gradation conversion circuit section is transmitted to the display device driver according to the predetermined transmission format.

What is claimed is:

1. A control circuit comprising:

a luminance control circuit section controlling a backlight luminance according to an inputted video signal;

a gradation conversion circuit section for converting a gradation of the inputted video signal according to the controlled luminance;

a circuit calculating an average value and a maximal value, representing the average value and the maximal value of gradation of the inputted video signal in one frame of the inputted video signal, respectively;

a feature value coefficient set point section setting a plurality of predetermined coefficients; and a feature value calculation circuit section calculating a feature value of the inputted video signal by a polynomial function configured by only four members, consisting of a member multiplying a coefficient by a square of the average value, a member multiplying a coefficient by the average value, a member multiplying a coefficient by the maximal value, and a member multiplying a coefficient by a product of the average value and the maximal value with use of the calculated maximal value, the calculated average value, and the predetermined coefficient, wherein the control circuit is configured to reduce continuously and smoothly the backlight luminance, in accordance with a continuous change of the inputted video signal from a state in which all pixels included in a screen area are white to a state in which the number of white pixels included in the screen area becomes one by gradually increasing an amount of area displayed in black in any part of the screen area, and the control circuit controls a reduction of the backlight luminance such that an amount of the luminance reduction is always less than or equal to an amount of the luminance reduction calculated by the calculated feature value, in comparison with the calculated amount of the luminance reduction.

2. The control circuit described in claim 1, wherein the feature value of the video signal (Rank) is determined by the following equation (1) with use of the calculated maximal value (MAX), the calculated average value (AVE), and any coefficients a, b, p, and q, $$\mathrm{Rank}=(a/p)\times(1-(b/q)\times\mathrm{AVE})\times\mathrm{AVE}+(1-(a/p)\times(1-(b/q)\times\mathrm{AVE}))\times\mathrm{MAX} \quad (1)$$

and the backlight luminance is determined by the following equation (2) with use of a corresponding Pulse Width Modulation (PWM) value, $$PWM=(\mathrm{Rank}/f(n))\hat{}2.2 \quad (2)$$

where f(n) is a maximal display gradation value which is 255 in a case of an 8-bit display.

3. The control circuit described in claim 2, wherein the average value and the PWM value have a relationship, in which a rate of change of the PWM value is small and a gradient thereof is gentle in an area where the average value is large, the rate of change of the PWM value becomes large and a gradient thereof becomes steep, as the average value becomes smaller, and the rate of change of the PWM value is always smooth and continuous.

4. The control circuit described in claim 2, wherein the any coefficients a and b are respectively set in a range of 1 to 1024 and a range of 0 to 31 to calculate the feature value of the video signal.

5. The control circuit described in claim 1, wherein the feature value coefficient set point section sets at least three coefficients and is configured to have a feature value coefficient calculation section changing at least one coefficient according to the calculated maximal value, and calculating the feature value of the video signal by the changed coefficient.

6. The control circuit described in claim 5, wherein a coefficient b_m is calculated by the following equation (3) with the calculated maximal value (MAX) and any coefficient b set by assuming the maximal value, and any coefficient c, $$b_m=(255/c)\times(f(n)/\mathrm{MAX})\times b \quad (3)$$

wherein f(n) is a maximal display gradation value which is 255 in a case of an 8 bit display, the feature value of the video signal (RANK) is determined by the following equation (4) with the calculated maximal value (MAX), the average value (AVE), the any coefficient a, the calculated coefficient b_m, and the coefficients p and q, $$\mathrm{Rank}=(a/p)\times(1-(b_m/q)\times\mathrm{AVE})\times\mathrm{AVE}+(1-(a/p)\times(1-(b_m/q)\times\mathrm{AVE}))\times\mathrm{MAX} \quad (4)$$

and the backlight luminance is determined by the following equation (5) with a corresponding Pulse Width Modulation (PWM) value, $$PWM=(\mathrm{Rank}/f(n))\hat{}2.2 \quad (5).$$

7. The control circuit described in claim 6, wherein the any coefficient c is set in a range of 1 to 254 to calculate the feature value of the video signal.

8. A display device equipped with the control circuit described in claim 1.

* * * * *